United States Patent [19]

Reinhold et al.

[11] Patent Number: 4,942,846

[45] Date of Patent: Jul. 24, 1990

[54] PORTABLE HEADCATCH SUPPORT AND ANIMAL RESTRAINING MECHANISM

[76] Inventors: John E. Reinhold, Rte. 70, Box 679; James F. Wilsman, Rte. 80, Box 228, both of Camdenton, Mo. 65020

[21] Appl. No.: 178,351

[22] Filed: Apr. 6, 1988

[51] Int. Cl.[5] ..... A61D 3/00

[52] U.S. Cl. ..... 119/103; 119/151

[58] Field of Search ..... 119/98, 99, 148, 149, 119/147.11, 103

[56] References Cited

U.S. PATENT DOCUMENTS

| | | | |
|---|---|---|---|
| 2,861,546 | 11/1958 | Stroup | 119/98 |
| 3,095,858 | 7/1963 | Bauer | 119/151 |
| 3,931,796 | 1/1976 | Hoffman | 119/151 |
| 4,195,595 | 4/1980 | Shimonovich | 119/103 |
| 4,214,555 | 7/1980 | Sauby | 119/103 |

*Primary Examiner*—Paul J. Hirsch

[57] ABSTRACT

A headcatch support framework is provided that can be removably mounted on differently sized pickup trucks or other vehicles adapted to receive the framework. The framework is adapted for attachment of a headcatch in a manner permitting the headcatch to be slidably and rotatably connected to the support frame such that the headcatch can be rotated on the framework between a storage position and a capturing position. The support frame is comprised of a vehicle widthwise portion, a longitudinal portion, a headcatch mounting bracket and a rod connecting the portions together to achieve slidable and rotational movement. The capturing position places the headcatch alongside the truck and the storage position is against the rear of the truck. The headcatch remains integral with the support frame. When the headcatch is in the capturing position alongside the vehicle, the combination of the vehicle, headcatch and support frame can be used as a corralling barrier to aid in capturing the animal by limiting the animal's movement in the direction of the truck.

34 Claims, 2 Drawing Sheets

PORTABLE HEADCATCH SUPPORT AND ANIMAL RESTRAINING MECHANISM

BACKGROUND OF THE INVENTION

This invention relates in general to headcatches and more particularly to a support for a headcatch that can be mounted on a vehicle in a manner permitting the headcatch to be rotated between a storage position and a capturing position, and where the combination of the vehicle, headcatch and supporting framework additionally acts as an animal restraining mechanism.

A headcatch, also referred to as a stanchion or pinch chute, is commonly used in ranching, farming, veterinary medicine and other professions dealing with animals. A headcatch is a device that allows an animal's head to be held relatively immobile so that the animal may be medically treated, groomed, or so that any desired procedure may be performed on the animal. The headcatch name is derived from the fact that the animal is usually held about the head or neck region. A headcatch is predominantly used with cattle. It is often necessary or convenient to perform a desired activity or treatment on an animal while it is in a field or in a pasture. Thus, a portable headcatch is necessary in order to treat the animal on location instead of transporting the animal to a barn or other area where a permanently positioned headcatch is available.

In order to quickly and efficiently administer the desired treatment on the animal while in the field, the headcatch must be transported to that site, preferably by a vehicle. Thus, portable headcatches mountable on a vehicle have been developed such as U.S. Pat. No. 4,574,741, issued Mar. 11, 1986, but this device is disadvantageous in that it does not enable the user of the headcatch to quickly disengage the headcatch from a storage position on the vehicle to the "in use" or capturing position in a rotational manner without removing the headcatch from the support frame. There is a need for a portable vehicle mounted headcatch that enables the user to quickly and easily position the headcatch alongside the vehicle for capturing an animal, such as cattle, and that can also provide a barrier to the animal's movement when herding the animal toward the headcatch.

SUMMARY OF THE INVENTION

The present invention provides an animal restraining mechanism and a method for capturing an animal that includes a headcatch and a support frame that can be removably mounted on a vehicle such as a pickup truck and where the headcatch can be rotated on the framework between a storage position and a capturing position. The vehicle can be positioned to act as a restraining barrier to movement by the animal to assist in herding and ultimately capturing the animal or the vehicle can be positioned opposite the side where said animal is being herded from. The support frame is adaptable for use on a variety of pickup trucks and for different types of headcatches.

It is a primary objective of this invention to provide a support for a headcatch that is mountable on a vehicle in a manner allowing the headcatch to rotate between a storage position and a capturing position quickly and conveniently without having to remove the headcatch from the support.

It is another object of this invention to provide a portable headcatch support that can be removably mounted on differently sized pickup trucks.

It is a further object of this invention to provide a headcatch support mountable on a vehicle that permits the vehicle to be a part of the animal restraining mechanism when the headcatch is in the capturing position by providing a barrier in one direction to the animal's movement.

It is still another object of the present invention to provide a pickup truck mounted headcatch support that includes a framework having a vehicle widthwise section, a longitudinal section and a rotatable headcatch mounting bracket.

It is a still further object of the present invention to provide such a framework including a bar that interconnects the sections of the framework and provides for rotational movement of the headcatch about the bar to quickly and easily move the headcatch between a storage position and a capturing position.

It is yet another object of the present invention to provide a pickup truck mounted headcatch support where the headcatch can conveniently and securely be stored against the back of the truck when not in use.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE PREFERRED EMBODIMENT

Figure 2:
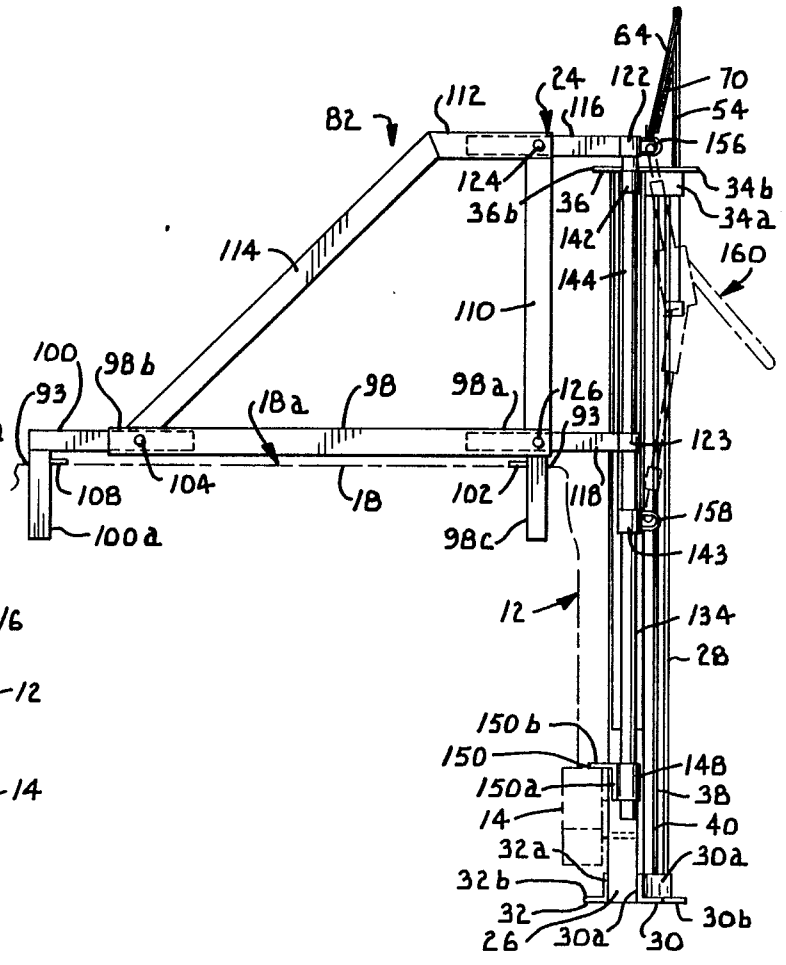
FIG. 2 is a side elevational view of the headcatch support frame mounted on a pickup truck.
Figure 1:
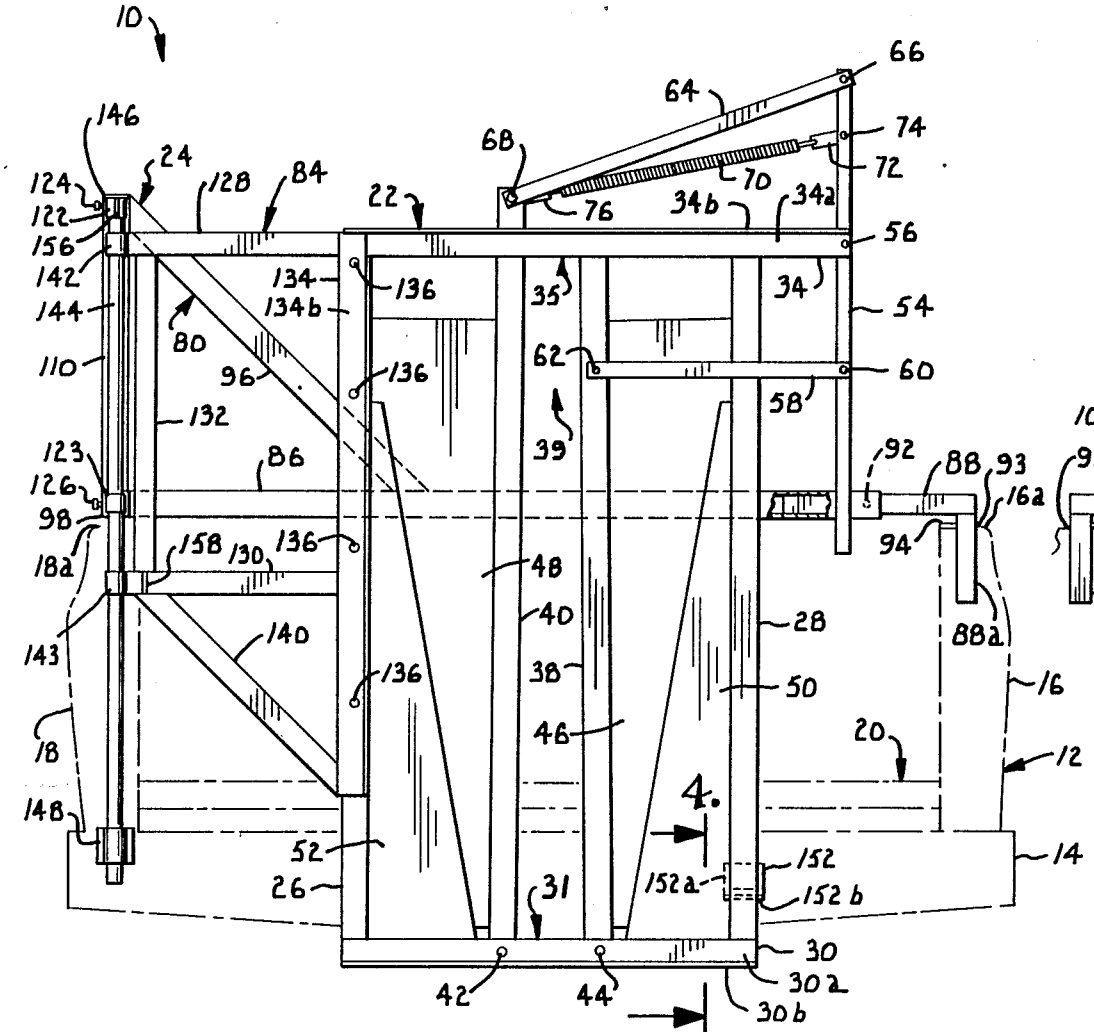
FIG. 1 is a rear elevational view showing the headcatch support frame mounted on a pickup truck with the headcatch in the storage position.
Figures 3, 4, 5:
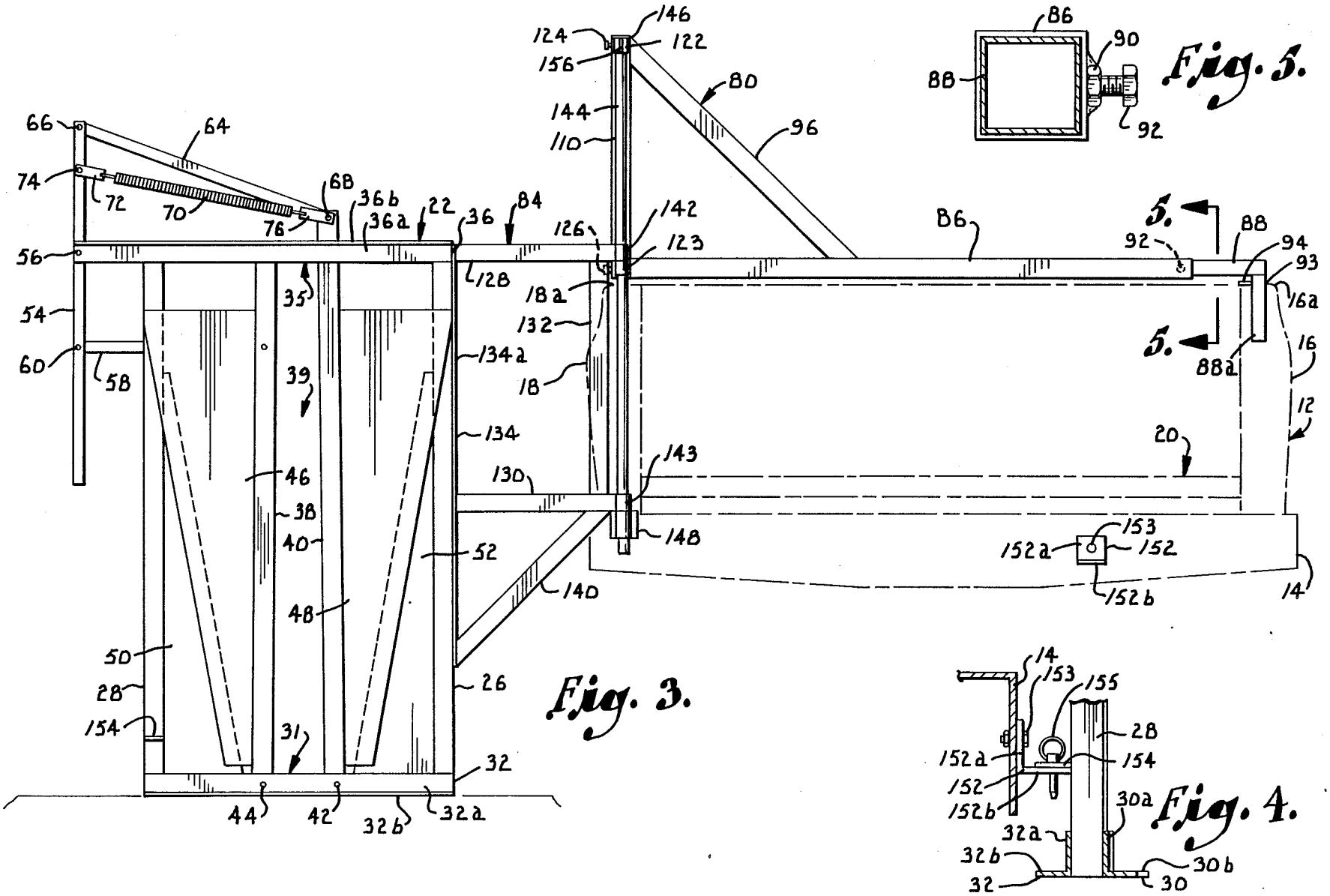
FIG. 3 is a rear elevational view of a headcatch support frame mounted on a pickup truck with the headcatch in the capturing position.
FIG. 4 is a side elevational view taken through the line 4—4 of FIG. 1 showing a means for securing the headcatch to the pickup truck when in the storage position.
FIG. 5 is a cross-sectional view through the line 5—5 of FIG. 3 showing means for securing the telescoping sections of the framework in rigid relationship with each other.

The overall device of the present invention is shown in FIGS. 1–3 and is generally designated by the numeral 10. The device 10 is shown mounted on a pickup truck 12 (shown throughout in phantom) having a rear bumper 14, sidewalls 16 and 18, and a bed 20. Sidewalls 16 and 18 of truck 12 each present an upper ledge **16*a* and 18*a*** respectively.

The device 10 of the present invention includes a headcatch 22 and a supporting framework designated generally by the numeral 24. A headcatch, also referred to as a stanchion or pinch chute, is a device that can effectively hold an animal in its head or neck region such that the animal remains generally immobile while a medical treatment or desired activity is performed upon the animal and cattle in particular. Any of the various types of headcatches available in the industry are applicable to be used in the present invention although it is to be understood that certain modifications to framework 24 to accommodate particular headcatches may be necessary to attach the headcatch thereto. As best shown in FIGS. 1 and 3, the preferred headcatch to be used with the present invention is shown and is similar to a headcatch identified as model 101-A that is manufactured by the Waddler Manufacturing Company Incorporated of Galena, Kans. The headcatch 22 as shown in FIGS. 1 and 3 has a generally rectangular framework comprised of posts 26 and 28, a pair of substantially parallel bottom rails 30 and 32, and pair of substantially parallel top rails 34 and 36. Each of said top and bottom rails are similarly shaped and present a flat surface designated 30*a*, 32*a*, 34*a*, and 36*a* and a flange surface extending generally perpendicular to said flat surface and designated 30*b*, 32*b*, 34*b* and 36*b*. Posts 26 and 28 are spaced apart and aligned generally perpendicular to said top and bottom rails 30, 32, 34, and 36. Posts 26 and 28 are positioned between bottom rails 30 and 32 at one end and between top rails 34 and 36 at their opposite end to form a rectangular frame and are connected to each other usually by welds. Posts 26 and 28 are formed in the shape of square tubes such that when the flat surface 30*a* of bottom rail 30 is attached to one side of post 26 and to the corresponding side of post 28 with flange 30*b* extending away from posts 26 and 28, and when flat surface 32*a* of bottom rail 32 is attached to the opposite side of post 26 and the corresponding side of post 28 in a similar manner, an opening 31 is created between bottom rails 30 and 32. An opening 35 is created between top rails 34 and 36 when said rails are attached to the top end of posts 26 and 28 in a manner similar to that just described. Top rails 34 and 36 are longer than bottom rails 30 and 32 and extend beyond post 28.

Disposed between posts 26 and 28 and within openings 31 and 35 are beams 38 and 40. Beam 38 is attached to bottom rails 30 and 32 by pin 44 and beam 40 is attached to bottom rails 30 and 32 by pin 42. Beam 40 extends through opening 35 and beam 38 extends into, but not out of, opening 35. Beams 38 and 40 are formed as square tubes each having two surfaces facing the inside of the headcatch frame and two surfaces facing outside of the headcatch frame. Attached to an outside surface of beam 38 is panel 46 and attached to an outside surface of beam 40 is panel 48. Panels 46 and 48 are attached to an outer surface of beams 40 and 38 such that said panels are not within openings 31 or 35. Panels 46 and 48 are wedge-shaped with their widths generally decreasing from top to bottom. Panels 46 and 48 are attached to beams 38 and 40 with their widest area being attached at the upper end of beams 38 and 40 near top rails 34 and 36 and with the panels extending toward posts 28 and 26 respectively. At their widest point, panels 46 and 48 contact with an outer surfaces of posts 28 and 26. Panels 46 and 48 extend downwardly to a lower portion of posts 38 and 40 just above bottom rails 30 and 32. Attached to an inner surface of posts 28 and 26 and positioned within opening 31 are panels 50 and 52. Panels 50 and 52 are permanently attached to posts 26 and 28 and to bottom rails 30 and 32. Panels 50 and 52 are wedge shaped with their width increasing from top to bottom. The placement of beams 38 and 40 and attached panels 46 and 48 within the headcatch frame is such that an opening 39 is formed between beams 38 and 40.

A lever 54 is positioned between the end of top rails 34 and 36 where they extend beyond post 28 in a manner permitting lever 54 to extend both above and below top rails 34 and 36. Lever 54 is secured to top rails 34 and 36 by a pin 56. Arm 58 is attached to lever 54 by pin 60 on one end and is attached to beam 38 by pin 62 at its opposite end. A second arm 64 is attached at one end to lever 54 by pin 66 and is attached to the portion of beam 40 extending through opening 35 at its other end by pin 68. A spring 70 is disposed between lever 54 and beam 40 and is attached to lever 54 by spring attachment 72 and pin 74 at one end of spring 70 and by spring attachment 76 and pin 68 at the other end of spring 70.

In order to widen opening 39 so that an animal's head may be placed therein, lever 54 is pulled in a direction away from the frame of headcatch 22 and lever 54 pivots about pins 56, 60 and 66. This movement pulls panel 46 in a direction toward post 28 and pushes panel 48 in a direction toward post 26 in a clam-shell like fashion. As lever 54 is pulled, beam 38 and connected panel 46 are pulled by connecting arm 58. The bottom of beam 38 pivots about pin 44 and remains attached thereto whereas the top of beam 38 between top rails 34 and 36 is unattached and moves freely within opening 39. Panel 46 slides along the outer surface of post 28 as it moves with beam 38. Simultaneously, lever 54 pivots about pin 66 in a manner pushing arm 64 which in turn pushes beam 40 and connected panel 48 toward post 26. The bottom of beam 40 pivots about pin 42 and remains attached thereto whereas the top of beam 40 between top rails 34 and 36 is unattached and moves freely within opening 39. Panel 48 slides along the outer surface of post 26 as it moves with beam 40. The outward movement of panels 46 and 48 is halted when an inner surface of beams 38 and 40 contact with the edge of panels 50 and 52 respectively.

In operation, when panels 46 and 48 move in opposite directions a wider opening 39 is created that has a width greater at its top than at its bottom. As the panels move, spring 70 becomes stretched. When opening 39 is adequately opened such that an animal's head may be placed therein, lever 54 may be released and panels 48 and 46 will move back toward the center of headcatch 22 through the compression of spring 70 as it returns to its original prestretched tension and such inward movement of beams 38 and 40 and panels 46 and 48 will be halted when the beams come in contact with the animals head or neck region.

Referring to FIGS. 1–3, framework 24 includes a vehicle widthwise portion 80, a longitudinal portion 82 and a headcatch attaching portion 84. Widthwise portion 80 of framework 24 comprises a first tubular member 86 and a second tubular telescoping member 88. Telescoping member 88 has a width slightly less than the width of tubular member 86 such that member 88 may be inserted into member 86. In the preferred embodiment of the present invention first tubular member 86 is two inch square tubing with one-eighth inch walls and second tubular telescoping member 88 is one and three-quarter inch square tubing with one-eighth inch walls. As shown in FIG. 5, a nut 90 is tack welded on an outer surface of one end of first tubular member 86 such that a threaded bolt 92 may be inserted into nut 90 and a corresponding aperture (not shown) in tubular member 86 such that bolt 92 contacts with a portion of telescoping member 88 when member 88 is within tubular member 86 permitting members 86 and 88 to be held in rigid relationship with each other. Telescoping member 88 may be inserted at varying distances within tubular member 86 in order to accommodate varying widths of vehicles or pickup trucks. Connected to telescoping member 88 is leg 88*a*. Leg 88*a* is also a tubular member that is rigidly secured, preferably welded, to telescoping member 88 and is flush with one end of member 88. Leg 88*a* is dimensioned to be inserted into an opening 93 that is formed in sidewall ledge 16*a* of pickup truck 12. In the preferred embodiment of the present invention said leg is a one and three quarter inch by one and one-eighth inch tube with one-eighth inch walls. Positioned on a surface of leg 88*a* facing the bed 20 of truck 12 is a stop bar 94 that extends outwardly from leg 88*a*. Stop bar 94 is generally parallel to and is positioned a distance below telescoping member 88 such that when leg 88*a* is inserted into the opening 93 of truck ledge 16*a*, telescoping member 88 is prevented from coming in direct contact with truck ledge 16*a* by bar 94. A tubular support member 96 extends at an angle from the top surface of first tubular member 86. Tubular support 96 is of such a length and inclined at such an angle so that its upper end comes in contact with the upper portion of longitudinal section 82 of framework 24 and tubular member 112 in particular. At its other end, supporting member 96 is rigidly secured to first widthwise section 86 preferably by welding said tubular structures together. The end of widthwise member 86 opposite the fastening means 90 and 92 is rigidly secured to one side of the bottom portion of longitudinal section 82 of framework 24, preferably by welds or the like.

Referring now to longitudinal portion 82 of framework 24 and FIG. 2 in particular, longitudinal portion 82 includes a first tubular member 98 and a second telescoping tubular member 100. Telescoping member 100 is of a dimension slightly less than the width of tubular member 98 such that it may be inserted into tubular member 98. In the preferred embodiment of the present invention, tubular member 98 is a two inch square tube with one-eighth inch walls and telescoping section 100 is a one and three quarter inch square tube with one-eighth inch walls. Tubular member 98 has a first end 98*a* and a second end 98*b*. A leg 98*c* extends generally perpendicular from the bottom surface of end 98*a* of said tubular member 98. Leg 98*c* is rigidly secured to member 98, preferably by welds and is dimensioned to be inserted into another opening 93 in side ledge 18*a* of truck 12. Positioned just below the intersection of leg 98*c* and tubular member 98 is a stop bar 102 that is generally parallel to first member 98 and supports longitudinal section 82 of framework 24 at a position just above ledge 18*a*. At end 98*b* of tubular member 98 a lock nut (not shown) is tack welded to the outer surfaces of member 98 to receive a threaded bolt 104 that is inserted into the nut and through an opening (not shown) in member 98 corresponding with the nut similarly to that shown in FIG. 5 to hold telescoping section 100 securely within tubular member 98.

At one end of telescoping member 100 is leg 100*a* extending downward and generally perpendicular to tubular section 100. This leg is designed to fit into another opening 93 in side ledge 18*a* of truck 12. Stop bar 108 is presented on an inner surface of leg 100*a* and extends outwardly therefrom and generally parallel to member 98 in order to rest the longitudinal section of framework 24 slightly above ledge 18*a* of truck 12 without having first member 98 or telescoping member 100 come directly in contact with ledge 18*a*. Telescoping member 100 may be inserted at varying lengths within first member 98 in order to accommodate varying truck sizes. Telescoping member 100 and first member 98 are held in rigid relationship by bolt 104 being inserted through a nut and an aperture such that the bolt contacts with telescoping member 100 and holds it securely in place.

Extending from the top surface of end 98*a* of tubular member 98 is another tubular member 110. Tubular member 110 is welded at one end to the surface of tubular member 98 opposite the surface upon which leg 98*c* is welded. Tubular member 110 is rigidly secured at its opposite end to tubular member 112. Tubular member 112 is positioned atop tubular member 110 so that it is substantially parallel to tubular member 98. One end of tubular member 112 is substantially flush with the edge of tubular member 110 whereas its opposite end is cut at an angle in order to receive bracing member 114. Bracing member 114 is tubular and extends at an angle between tubular member 98 and tubular member 112. Tubular member 114 is welded to the top surface of end 98*b* of tubular member 98 and is welded at its other end to the angled edge of tubular member 112. Tubular member 114 supports tubular member 112 in a sturdy manner. Support member 96 of widthwise section 80 is welded to the inner surface of tubular member 112 at the end where it attaches to member 110. The inner surface of end 98*a* of tubular member 98 is where tubular member 86 of widthwise section 80 is connected to longitudinal section 82. In the preferred embodiment of the present invention, each of tubular members 110, 112 and 114 are constructed of two inch square tubings with one-eighth inch walls.

Extension arms 116 and 118 are tubular members comprised of one and three quarter inch square tubings with one-eighth walls that are inserted into tubular member 112 and tubular member 98 respectively. Extension arm 116 is inserted into tubular member 112 and held in rigid relationship therewith by a threaded bolt 124 inserted into a nut (not shown) attached to one surface of tubular member 112 and through a corresponding aperture (not shown) in member 112 so that bolt 124 contacts with arm 116 to securely hold it in place. Extension arm 118 is inserted into tubular member 98 and held in rigid relationship therewith by a threaded bolt 126 that is inserted through a nut (not shown) welded to one surface of end 98*a* of member 98 and through a corresponding aperture in member 98 (not shown). Bolt 126 contacts with arm 118 when it is inserted into member 98. Extension arms 116 and 118 may therefore be positioned at varying distances within member 112 and 98 so that they may extend therefrom at a distance as is desired for a particular vehicle or truck. Welded to the end of arm 116 that extends outwardly from member 112 is a hollow tube 122. An identically formed hollow tube 123 is welded to the outwardly extending end of arm 118. Arms 116 and 118 are positioned within their respective members 112 and 98 such that tubes 122 and 123 are aligned with each other and so that the hollow portion of said tubes are in a vertical alignment.

Referring now to headcatch attachment 84, which is best shown in FIG. 3, a generally rectangular frame is formed by top tubular member 128 and bottom tubular member 130 which are spaced apart and generally parallel to each other, vertical tubular member 132 and vertical angular member 134. Vertical tubular member 132 is welded at one end to the bottom surface of top member 128 and at its opposite end to the top surface of bottom member 130. Angular member 134 is generally parallel to member 132 and attached at on end to top member 128 and at a point near its opposite end to bottom member 130. Member 134 can also be described as a "corner" bracket having a surface 134a generally perpendicular to a surface 134b. First surface 134a is attached to top and bottom members 128 and 130 and second surface 134b contacts with headcatch post 26. Angular member 134 has a plurality of openings (not shown) on surface 134b that are formed to match openings (not shown) formed in headcatch post 26 such that a nut and bolt assembly 136, can be used to attach angular member 134 to headcatch 22. Angular member 134 attaches to top member 128 so that it is substantially flush with the top surface of top member 128 and extends beyond bottom member 130 a distance sufficient to contact with brace 140. Brace 140 is a tubular member that extends from the bottom surface of bottom member 130 to surface 134a of angle member 134. Brace 140 is securely connected to bottom member 130 and to angle member 134 by welds. Brace 140 serves to further support headcatch 22 on headcatch mounting bracket 84. When mounting headcatch 22 on framework 84, flange surface 34b of top rail 34 is positioned to contact with the upper edge of surface 134b of angular member 134 and corresponding apertures are formed in member 134 and post 26 to receive nut and bolt assembly 136. Post 26 is positioned so that two of its surfaces contact with the inner surfaces of corner member 134.

Top tubular member 128 presents a hollow tube 142 welded to its end opposite said end attached to said angular member 134. Bottom tubular member 130 presents a hollow tube 143 welded to its end opposite said end attached to angled member 134. Both of tubes 142 and 143 are positioned to extend beyond the rectangular frame bounded by member 132. The openings of the tubes are aligned vertically.

In order to attach the headcatch attaching framework 84 to the longitudinal support 82 and the widthwise framework 80, rod 144 having a cap or washer 146 securely attached at one end of rod 144 is provided that can be inserted through the hollow tubes which have been positioned so that each of their openings are vertically aligned together. Cap 146 is of a diameter sufficiently greater than that of the hollow tubes such that it can rest atop tube 122 and not slide therethrough. In the preferred embodiment of this invention, each of the hollow tubes has an inner diameter of one and one quarter inch and rod 144 has an inner diameter of one inch with a two inch diameter cap 146.

In order to obtain both vertical and rotational movement of headcatch 22 on framework 24, top member 128, and its adjacent hollow tube 142, is positioned between extension arms 116 and 118 and the open portion of tube 142 is aligned with the open portion of hollow tubes 122 and 123. The hollow tubes are now arranged in the following vertical order, from top to bottom, 122, 142, 123, and 143. Rod 144 is inserted vertically therethrough until cap 146 comes in contact with the upper surface of tube 122 to prevent rod 144 from sliding through the tubes. As a result, headcatch 22 can be moved vertically when attached to headcatch framework 84 through the distance bounded by tubes 122 and 123. Headcatch 22 can also be rotated about rod 144 through rotational movement of headcatch mounting bracket 84. Bar or rod 144 is maintained in a substantially vertical position by a stabilizing tube 148 that is attached to bumper 14 of pickup truck 12 by means of angle iron 150. Angle iron 150 has one surface 150a that is welded to tube 148 and a second surface 150b that is attached to bumper 14 of truck 12 by a nut and bolt assembly (not shown) through an aperture in angle iron surface 150b and through a corresponding aperture in bumper 14 (not shown). Manifestly, stabilizing tube 148 must be aligned with tubes 122, 123, 142 and 143 in a manner permitting rod 144 to be in a substantially vertical alignment.

To prepare device 10 for use, vehicle widthwise portion 80 of framework 24 is adjusted via tubular members 86 and 88 and bolt 92 to the desired width to fit the particular vehicle or pickup truck and longitudinal portion 82 of framework 24 is likewise adjusted via tubular members 98 and 100 and bolt 104 to the desired length. Leg 88a of widthwise portion 80 and legs 98c and 100a of longitudinal portion 82 of framework 24 are then inserted into their corresponding previously formed openings 93 in sidewall ledges 16a and 18a. Widthwise portion 80 and longitudinal portion 82 of framework 24 are positioned slightly above sidewalls 18a and 16a by virtue of stop bars 94, 102, and 108. Extension arms 116 and 118 are then inserted into corresponding tubular members 112 and 98 to the desired distance away from the truck by inserting the corresponding bolt 124 or 126 through the corresponding aperture in members 112 and 98 until arms 116 and 118 are securely held in place. Hollow tubes 122 and 123 are aligned in a vertical manner and stabilizing tube 148 is attached to bumper 14 by an angle iron 150 in a manner in vertical alignment with tubes 122 and 123. A headcatch 22 is then attached to headcatch attachment framework 84 by nut and bolt assembly 136 through corresponding apertures in corner member 134 and headcatch post 26. Headcatch attachment 84 is then positioned with top tubular member 128 and corresponding hollow tube 142 between hollow tubes 122 and 123 with the hollow portion of tube 142 in vertical alignment with the hollow portion of tubes 122 and 123. Simultaneously, bottom tubular member 130 of headcatch support framework 84 and its adjacent hollow tube 143 is positioned between hollow tube 123 and stabilizing tube 148 in a manner where the hollow portion of tube 143 is in vertical alignment with the corresponding hollow portions of tubes 122, 142, 123 and stabilizing tube 148. At this point the headcatch attaching framework 84 and attached headcatch 22 may be resting on the ground or any other surface or can be held in place. Rod 144 is then inserted through the hollow portions of tubes 122, 142, 123, 143 and stabilizing tube 148 respectively. Rod 144 is allowed to extend fully through said column of tubes until cap 146 contacts with the uppermost edge of tube 122 preventing any further downward movement of the rod.

At this point, headcatch 22 is capable of being moved in a vertical, or up and down, manner with its boundaries being limited upward when tube 142 comes in contact with tube 122 and downward when tube 142 comes in contact with tube 123. Headcatch support framework 84 and headcatch 22 can also be rotated about the axis created by rod 144 in a manner permitting headcatch 22 to be rotated away from truck 12 for use in capturing an animal as illustrated in FIG. 3. A desired treatment or activity may be performed upon said animal and the headcatch can then be rotated back to a storage position against truck 12 as illustrated in FIG. 1.

To move headcatch 22 to a storage position, headcatch support framework 84 and its attached headcatch 22 are moved upward along rod 144 and rotated toward the bumper 14 of truck 12 until headcatch 22 is positioned behind truck 12. In this position, the headcatch is not directly parallel to the rest of the truck, but is slightly angled as is shown in FIG. 2. This angle can be eliminated by adjusting the distance that rod 144 is positioned from the truck. In order to securely attach headcatch 22 in its storage position above the ground and just behind truck 12, storage locking member 152 is attached to bumper 14 of truck 12. Storage locking member 152 is an angle iron presenting two surfaces 152*a* and 152*b* substantially perpendicular to each other. On surface 152*a* is an opening (not shown) to receive means for fastening nut and bolt arrangement 153 through a corresponding opening in bumper 14 (not shown). On surface 152*b* is a second opening (not shown) to receive a locking pin 155 or other fastening means to secure headcatch 22 to storage member 152. A corresponding locking flange 154 is presented on the back surface of post 28 of headcatch 22.

In order to facilitate easier vertical movement of headcatch 22 attached to headcatch attaching framework 84, a ring 156 is presented on tube 122 and another ring 158 is presented on bottom tubular member 130 of headcatch attaching framework 84. Both rings 156 and 158 are oriented away from framework 24 in order to accommodate a "come-a-long" or rachet system or other device, generally designated by the numeral 160 and shown in phantom in FIG. 2, to facilitate the raising and lowering of headcatch attachment framework 84 and its adjoined headcatch 22. The openings in rings 156 and 158 are aligned generally horizontally.

In order to move headcatch 22 from its storage position to its capturing position, lock pin 155 is removed from the corresponding apertures in flange 154 and storage member 152 in order to enable rotational movement of headcatch attaching framework 84 and attached headcatch 22. Headcatch attaching framework 84 can be rotated and lowered simultaneously or it can be rotated to a position alongside the truck and then lowered by releasing the come-a-long and allowing headcatch attaching framework 84 and its adjoined headcatch 22 to come in contact with the ground or other surface. At this point headcatch 22 is alongside or at another desired position adjacent truck 12 and the animal to be treated can be herded toward headcatch 22 in a manner utilizing truck 12 as a herding barrier to movement by said animal if the animal is being herded from the direction of the truck or the headcatch can be used without the aid of the truck as a barrier. Once the animal is in position for capturing in headcatch 22, the headcatch can be operated as described above.

When headcatch 22 is in its capturing position, it is conceived to be used in conjunction with gates, allies, runways, or other restraining panels as are needed to facilitate capturing said animal or for facilitating further treatment of said animal.

From the foregoing, it will be been that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to the accompanying drawings is to be interpreted as illustrative and not in a limiting sense.

Having thus described the invention we claim:

1. An animal restraining mechanism comprising:

a vehicle;

a headcatch for temporarily capturing and restraining said animal; and means for mounting said headcatch on said vehicle in order that said headcatch can rotatably move between a storage position and a capturing position in a manner permitting said vehicle to form a part said restraining mechanism when said headcatch is rotated said capturing position adjacent said vehicle by providing a barrier in one direction to movement by said animal.

2. An animal restraining mechanism as set forth in claim 1 wherein said mounting means comprises:

a support frame removably connected to said vehicle;

a rod rotatably connected to said support frame;

a mounting bracket slidably and rotatably connected to said rod and being adapted to connect to said headcatch; and means for mounting said rod in a vertical position relative to said vehicle.

3. An animal restraining mechanism as set forth in claim 2 wherein said support frame comprises a vehicle widthwise portion and a longitudinal portion generally perpendicular to said vehicle widthwise portion.

4. An animal restraining mechanism as set forth in claim 3 wherein said vehicle widthwise portion includes first and second telescoping members and means for holding said members in rigid relationship whereby the width of said support frame is variable, said second member being adapted to be removably connected to said vehicle.

5. An animal restraining mechanism as set forth in claim 4 wherein said longitudinal portion including first and second telescoping members and means for holding said members in rigid relationship whereby the length of said support frame is variable, said first and second members being adapted to be removably connected to said vehicle.

6. An animal restraining mechanism as set forth in claim 5 wherein said longitudinal portion of said support frame further comprises:

a vertical member having top and bottom ends connected at its bottom end to said first telescoping member, generally perpendicular thereto and extending upwardly therefrom;

a horizontal member connected to said top end of said vertical member and generally parallel to said first telescoping member;

an angled member between said horizontal member and said first telescoping member and rigidly connected thereto; and means extending from said first telescoping member and said horizontal member for rotatably and slidably connecting said rod thereto.

7. An animal restraining mechanism as set forth in claim 6 wherein said extending means comprises a first arm adapted to be positioned within said first telescoping member and means for holding said members in rigid relationship whereby the distance said arm extends from said telescoping member is variable and a second arm adapted to be positioned within said horizontal member and means for holding said members in rigid relationship whereby the distance said second arm extends from said horizontal member is variable.

8. An animal restraining mechanism as set forth in claim 7 wherein said first and second arms include a hollow tube connected to the end of said arm extending out of said telescoping member and said horizontal member in a manner permitting said rod to slidably and rotatably fit therethrough.

9. An animal restraining mechanism as set forth in claim 8 wherein said vehicle widthwise portion further includes a brace rigidly connected to said first telescoping member of said vehicle widthwise portion of said support frame and to said first horizontal member of said longitudinal portion of said support frame.

10. An animal restraining mechanism as set forth in claim 2 wherein said mounting bracket comprises:

a generally rectangular frame having top and bottom horizontal members, each having first and second ends;

a vertical member connected between said top and bottom members at said first end; and a headcatch attaching member having first and second surfaces, said first surface connected to said second end of said top and bottom members.

11. An animal restraining mechanism as set forth in claim 10 wherein said second surfaces of said headcatch attaching member is adapted to receive means for rigidly securing said headcatch thereto.

12. An animal restraining mechanism as set forth in claim 10 wherein a hollow tube extends from said first end of said top and bottom horizontal members said hollow portion of said tubes aligned in a vertical manner permitting said rod to slidably and rotatably fit therethrough.

13. An animal restraining mechanism as set forth in claim 10 wherein said headcatch attaching member extends below said bottom horizontal member.

14. An animal restraining mechanism as set forth in claim 13 wherein said mounting bracket includes a brace connected between said bottom horizontal member and said headcatch attaching member.

15. An animal restraining mechanism as set forth in claim 2 wherein said rod presents a cap at one end having a diameter greater than the diameter of said hollow tubes permitting said cap to rest atop the uppermost of said hollow tubes.

16. An animal restraining mechanism as set forth in claim 1 wherein said vehicle is a pickup truck including a bed, sidewalls and a bumper.

17. An animal restraining mechanism as set forth in claim 16 wherein said truck sidewalls have an upper ledge into which apertures are formed to fittingly and removably receive said support frame.

18. An animal restraining mechanism as set forth is claim 2 including means for accommodating the use of a device to assist in vertical movement of said headcatch when attached to said mounting bracket.

19. An animal restraining mechanism as set forth claim 18 wherein said accommodating means comprises a first ring attached to at least one of said tubes on said extension arms and a second ring attached to at least one of said horizontal members of said mounting bracket.

20. An animal restraining mechanism as set forth in claim 2 wherein said means for maintaining said rod comprises an angled member having first and second surfaces, said first surface having means for connecting said angled member to said vehicle and said second surface having a hollow tube connected thereto, whereby said means can be positioned on said vehicle in vertical alignment with said other tubes to rotatably receive said rod 21. An animal restraining mechanism as set forth in claim 2 including means for securing said headcatch to said vehicle when in said storage position.

22. An animal restraining mechanism as set forth in claim 2 wherein said means for securing said headcatch said first surface presenting means for connecting said angled member to said vehicle and said second surface presenting an aperture corresponding with an aperture on a flange of said headcatch to removably receive a fastener in a manner preventing rotational movement of said headcatch when in said storage position.

23. A portable headcatch comprising:

a vehicle;

a headcatch for temporarily capturing and restraining said animal;

means for mounting said headcatch on said vehicle in a manner permitting said headcatch to rotatably move between a storage position and a capturing position; said mounting means including;

a support frame removably connected to said vehicle;

a rod rotatably connected to said support frame;

a mounting bracket slidably and rotatably connected to said rod and being adapted to connect to said headcatch; and means for mounting said rod in a vertical position relative to said vehicle.

24. A portable headcatch as set forth in claim 23 wherein said support frame comprises a vehicle widthwise portion and a longitudinal portion generally perpendicular to said vehicle widthwise portion.

25. A portable headcatch as set forth in claim 24 wherein said vehicle widthwise portion includes first and second telescoping members and means for holding said members in rigid relationship whereby the width of said support frame is variable, said second member being adapted to be removably connected to said vehicle.

26. A portable headcatch as set forth in claim 25 wherein said longitudinal portion included first and second telescoping members and means for holding said members in rigid relationship whereby the length of said support frame is variable, said first and second members being adapted to be removably connected to said vehicle.

27. A portable headcatch as set forth in claim 26 wherein said longitudinal portion of said support frame further comprises:

a vertical member having top and bottom ends connected at its bottom end to said first telescoping member, generally perpendicular thereto and extending upwardly therefrom;

a horizontal member connected to said top end of said vertical member and generally parallel to said first telescoping member;

an angled member between said horizontal member and said first telescoping member and rigidly connected thereto; and means extending from said first telescoping member and said horizontal member for rotatably and slidably connecting said rod thereto.

28. A portable headcatch as set forth in claim 27 wherein said extending means comprises a first arm adapted to be positioned within said first telescoping member and means for holding said members in rigid relationship whereby the distance said arm extends from said telescoping member is variable and a second arm adapted to be positioned within said horizontal member and means for holding said members in rigid relationship whereby the distance said second arm extends from said horizontal member is variable.

29. A portable headcatch as set forth in claim 28 wherein said first and second arms include a hollow tube connected to the end of said arm extending out of said telescoping member and said horizontal member in a manner permitting said rod to slidably and rotatably fit therethrough.

30. A portable headcatch as set forth in claim 29 wherein said vehicle widthwise portion further includes a said vehicle widthwise portion of said support frame and to said first horizontal member of said longitudinal portion of said support frame.

31. A portable headcatch as set forth in claim 23 wherein said mounting bracket comprises:

a generally rectangular frame having top and bottom horizontal members, each having first and second ends;

a vertical member connected between said top and bottom members at said first end; and a headcatch attaching member having first and second surfaces, said first surface connected to said second end of said top and bottom members.

32. A portable headcatch as set forth in claim 31 wherein said second surfaces of said headcatch attaching member is adapted to receive means for rigidly securing said headcatch thereto.

33. A portable headcatch as set forth in claim 31 wherein a hollow tube extends from said first end of said top and bottom horizontal members said hollow portion of said tubes aligned in a vertical manner permitting said rod to slidably and rotatably fit therethrough.

34. A portable headcatch as set forth in claim 23 wherein said vehicle is a pickup truck including a bed, sidewalls and a bumper.

* * * * *